United States Patent [19]

Roy

[11] 4,133,520

[45] Jan. 9, 1979

[54] DECOLLATOR

[75] Inventor: David M. Roy, Union, N.H.

[73] Assignee: Moore Business Forms, Inc., Niagara Falls, N.Y.

[21] Appl. No.: 834,513

[22] Filed: Sep. 19, 1977

[51] Int. Cl.[2] ..... B65H 41/00

[52] U.S. Cl. ..... 270/52.5

[58] Field of Search ..... 270/52.5

[56] References Cited

U.S. PATENT DOCUMENTS

| | | | |
|---|---|---|---|
| 3,079,142 | 2/1963 | Pine | 270/52.5 |
| 3,386,729 | 6/1968 | Pine | 270/52.5 |
| 3,520,530 | 7/1970 | Gill | 270/52.5 |
| 3,991,993 | 11/1976 | Clouthier | 270/52.5 |
| 4,018,431 | 4/1977 | Schueler | 270/52.5 |

*Primary Examiner*—Edgar S. Burr

*Assistant Examiner*—A. Heinz

*Attorney, Agent, or Firm*—Watson, Cole, Grindle & Watson

[57] ABSTRACT

A forms decollator for separating superimposed continuous forms into separate plies has a pair of abrasive rolls rotatable in opposite directions away from one another and a separator roll bearing thereagainst and wholly supported thereby so that, together with the abrasive rolls, the forms may be separated as they are moved between the abrasive rolls and through the nips of the separator roll and each abrasive roll so as to be directed over guide elements and refolded over pack breakers which permit the separated plies to be neatly refolded. The guide elements have undercut portions near their terminal ends to avoid interference with the separated plies during the process of refolding.

10 Claims, 4 Drawing Figures

DECOLLATOR

BACKGROUND OF THE INVENTION

This invention relates generally to an improved decollator, and more particularly to a machine for positively separating continuous forms into separated plies.

In the decollating process continuous superimposed forms folded in a zigzag stack are separated into plies by means of rotatable rolls which direct the separated plies over guides associated with the rolls. The separated plies are then refolded into separated zigzag stacks. Forms which are detachably connected together along one or both marginal edges, or are otherwise difficult to separate, however, present special problems during the decollating process since the connections oftentimes snag or pull during detachment thereby affecting the quality of the refold stacks as well as the smooth operation of the decollating process itself. The forms in the process of being separated into separate plies have a tendency to lift off the rotatable rolls so that slippages occur which cause uneven separation of the plies. Besides, decollators have in the past been designed as relatively complex and bulky machines which render them unwieldy and nonportable.

SUMMARY OF THE INVENTION

It is therefore an object of the present invention to avoid the difficulties found with the use of prior decollators in separating especially detachably connected continuous forms or those having a tendency to adhere together, by devising a decollator which will insure positive separation of the forms in a simple and economical yet highly effective manner. Also, the decollator according to the invention is designed for refolding the separated plies into zigzag refolded stacks in a smooth and uninterrupted refolding operation insuring neat appearing and readily usable refolded stacks.

In carrying out this objective, the decollator has legs for mounting it on a table surface or the like which likewise supports a stack of zigzag-folded continuous forms to be separated. The forms are fed between a pair of abrasive rolls rotatable in opposite directions away from one another, and the forms respectively extend through nips between a separator roll and each of the rotatable rolls. This separator roll is of a shorter length compared to that of the rotatable rolls and is designed to bear thereagainst along substantially the central portion thereof. The separator roll is wholly supported by the rotatable rolls, and is formed with a central crown so as to avoid side-to-side tracking, i.e., movement along its central axis, during rotation of the rotatable rolls. The peripheral surfaces of the rotatable rolls are roughened or are otherwise rendered abrasive so as to avoid slippage of the separated plies during the process of directing them over guide means designed to permit a "waterfall effect" of the separated plies as they fall into refolded stacks on portions of the surface lying outwardly of the decollator legs. The guides are undercut near their lower ends to avoid any interference during the refolding operation, and stacker bars in the form of angle irons maintain the centers of the refolded stacks bowed upwardly so as to avoid any interference between folded plies during the refolding process.

DETAILED DESCRIPTION OF THE INVENTION

Figure 1:
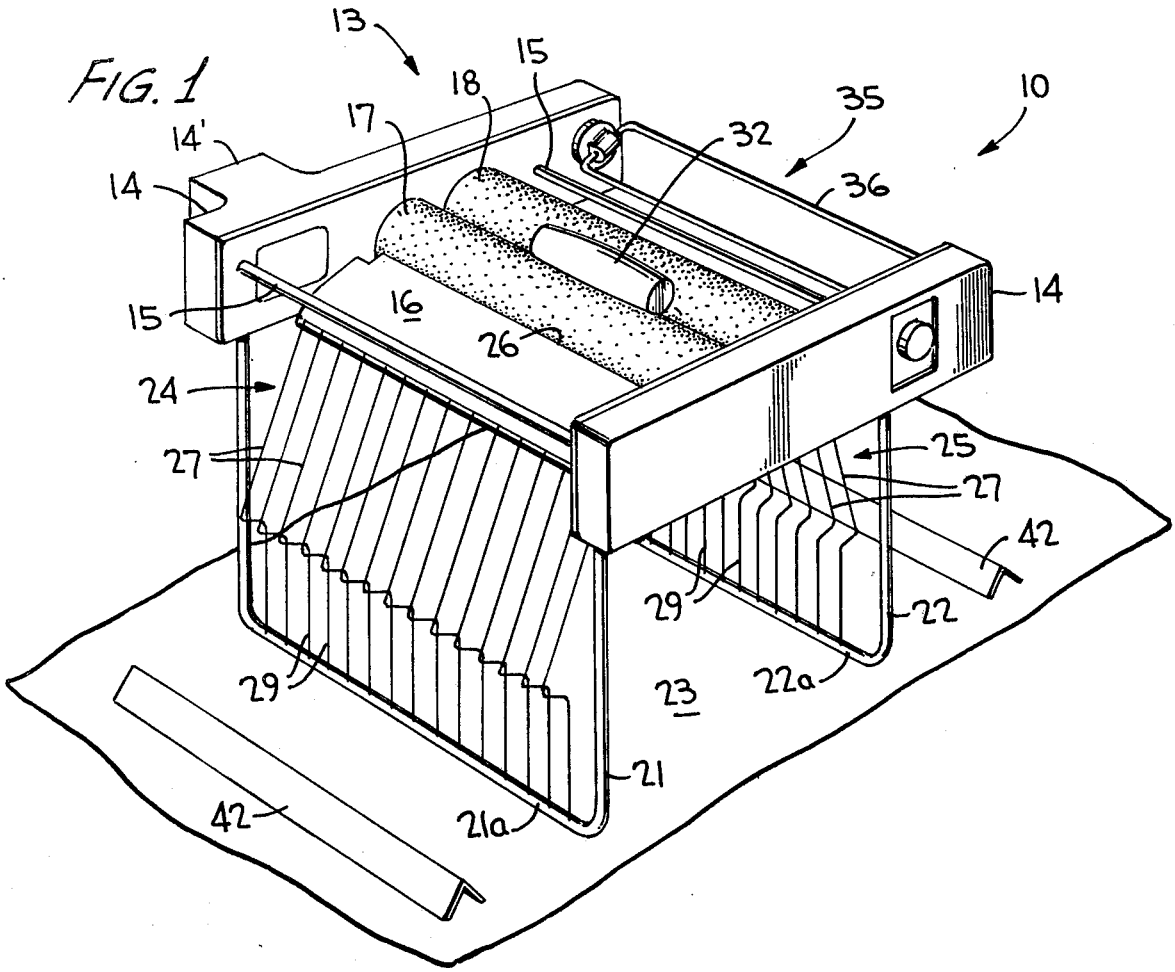
FIG. 1 is a perspective view of the decollator according to the invention.
Figure 2:
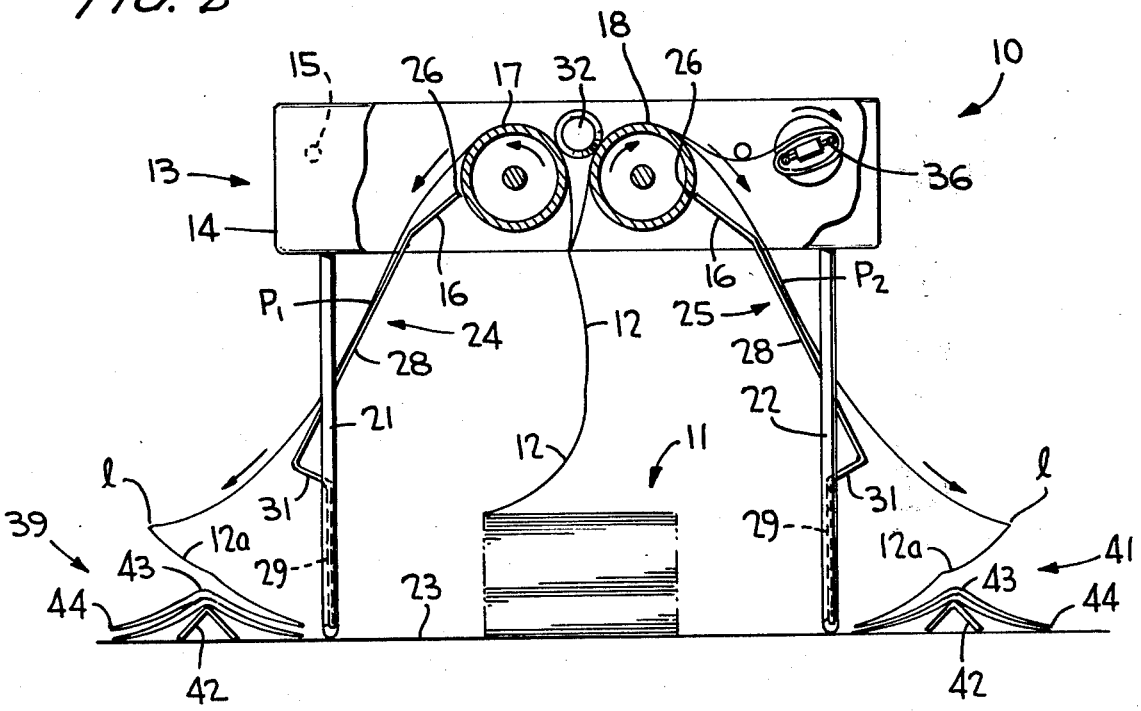
FIG. 2 is a side elevational view of the decollator of FIG. 1 partly broken away to show several details thereof.

Turning now to the drawings wherein like reference characters refer to like and corresponding parts throughout the several views, the decollator is generally designated 10 in FIGS. 1 and 2 and comprises a machine for separating a stack 11 of at least two superimposed continuous business forms comprised of series-connected sheets 12 which are zigzag folded along their fold lines l in the usual manner to form stack 11. The machine according to the invention comprises an upper framework structure 13 of hollow side plates 14 interconnected in spaced relation as by connecting bars 15 and guide plates 16. A pair of rolls 17 and 18 are mounted for rotation within suitable bearings on and between side plates 14. And, through suitable gearing provided on the rolls and a motor and clutch (not shown) located within housing 14' and operatively connected with the gearing, rolls 17 and 18 are designed to be rotated at a constant speed in opposite directions away from one another, as shown by the arrows in FIG. 2. The clutch is designed to allow the rolls to stop, preventing serious injury to an operator who inadvertently contacts them while the motor is on. An ON–OFF control dial 19 located on one of the side plates may be manually manipulated to control operation of rolls 16 and 17.

Mounted on the framework structure are a pair of spaced depending legs 21 and 22 of generally U-shaped configuration designed for the support of the decollator on a flat surface 23 which likewise supports stack 11 as shown in FIG. 2. Guide means for the separated plies are generally designated 24 and 25 and each include a guide plate 16 mounted at opposite ends to side plates 14 and having an inner edge 26 lying closely adjacent its respective rolls 17 and 18 below the top portions thereof. Each guide means further includes a plurality of spaced wires or slender rods 27 with portions 28 thereof (see FIG. 2) sloping downwardly toward their adjacent legs 21 and 22 at angles from the vertical of between 15 to 30 degrees. The terminal ends of rods 27 are mounted on respective segments **21*a* and 22*a* of the legs, and portions 29 of rods 27 extend vertically adjacent their terminal ends as shown in FIGS. 1 and 2. Outwardly extending portions 31 of the rods interconnect portions 28 and 29** and define undercuts therewith for a purpose to be hereinafter described.

Figure 4:
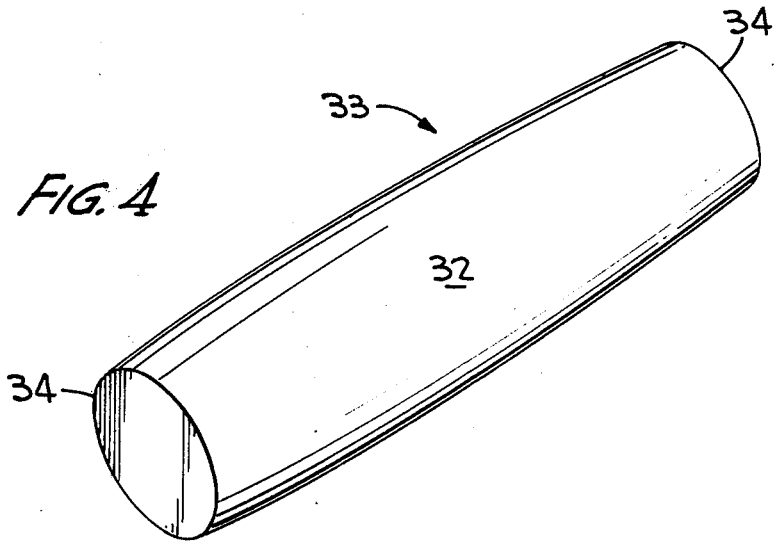
FIG. 4 is an enlarged perspective view of the separator roll as part of the decollator according to the invention.

A separator roll 32, having a length substantially less than the length of rolls 17 and 18, bears against the outer peripheries of rolls 17 and 18 and is wholly supported by these rolls which are spaced sufficiently close relative to the size of the separator roll for the support thereof. Separator roll 32 is otherwise not mounted on any portion of the decollator since it is designed to frictionally engage the forms or be capable of rotating in either direction depending on the conditions taking place during the forms separation process, as to be later described. The separator roll is a variable diameter cylinder having a central crown, as clearly shown in FIG. 4, which is defined by a larger circular cross-section at its mid-portion 33 than at its opposite ends 34. In longitudinal cross-section, this separator roll would be shown as defined by spaced curved lines of large radii. Hence, the separator roll bears against rolls 17 and 18 substantially at mid-portion 33 thereof. And, the crowned configuration of the separator roll substantially prevents it from tracking side-to-side, i.e., from moving along its central axis, during the decollating operation.

A carbon or transfer sheet rewind means 35 is also mounted for rotation on and between side plates 14 and includes a rewind reel 36 which is geared through a clutch (not shown) to rolls 17 and 18 for rotation at a slightly faster rate relative thereto. The rewind reel is designed to slightly overspeed rolls 17 and 18 to assure tension in the carbon web as it is extracted and, the clutch is provided to prevent the tension in the carbon web and the overspeed of the rewind reel from becoming excessive as the diameter of the extracted carbon increases on the reel.

Figure 3:
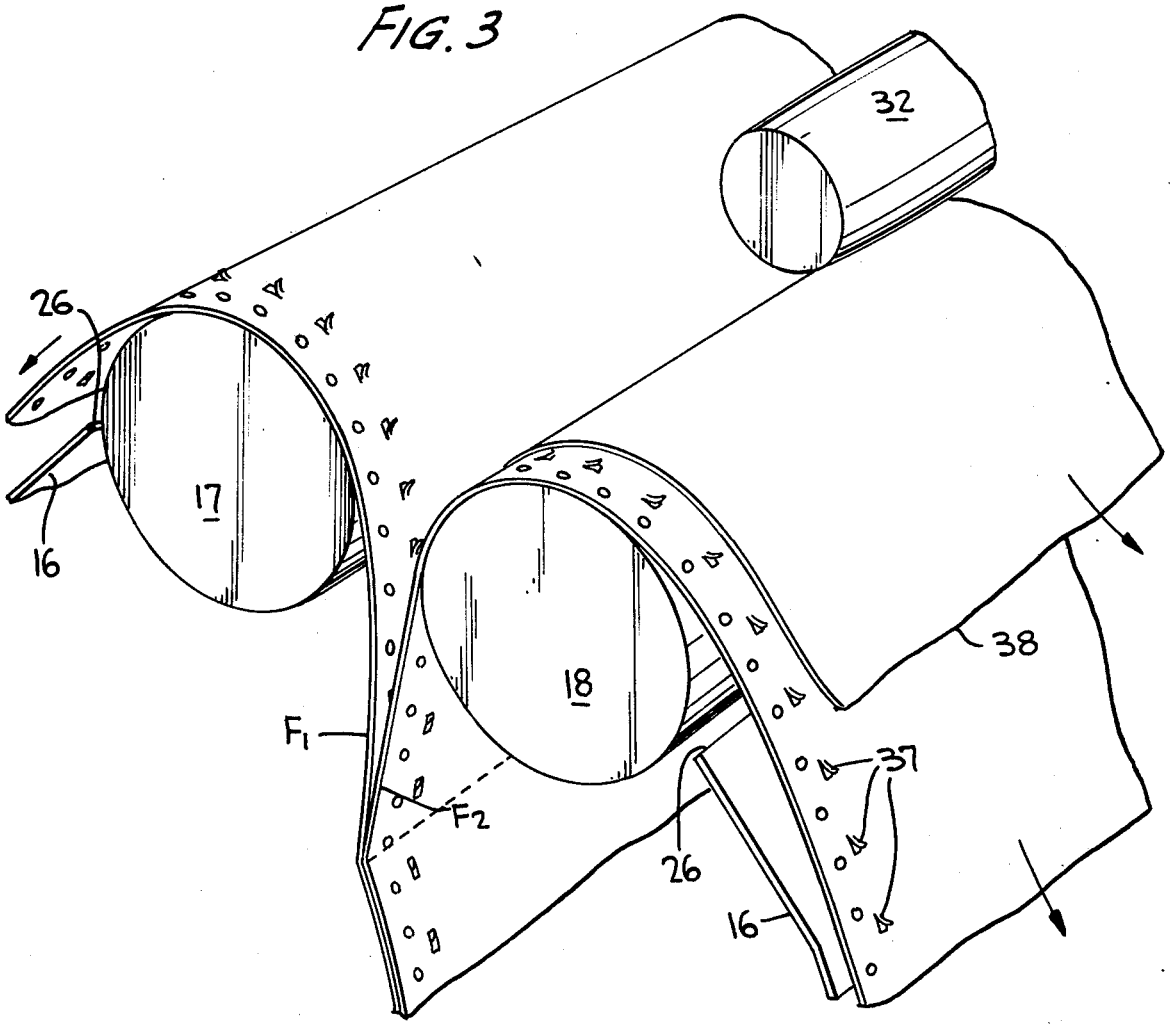
FIG. 3 is an enlarged perspective view showing a part of the decollator of FIG. 1.

Continuous forms such as $F_1$ and $F_2$ shown in FIG. 3 are oftentimes interconnected along at least one marginal edge by interlocking means in the form of paper staples 37 which are substantially formed by punching tongues through overlying forms so that these tongues intertwine thereby forming a non-adhesive connecting means. Such paper staples form detachable connecting means as does detachable glue which would otherwise be used in connecting forms $F_1$ and $F_2$ together. A continuous web of carbon transfer material 38 may be interleaved between the forms.

In the webbing-up operation, the interconnected forms $F_1$ and $F_2$ with their interleaved carbon strip are extended between rolls 17 and 18 with form $F_1$ thereafter extended through the nip between rolls 17 and 32, while carbon strip 38 and continuous form $F_2$ are extended through the nip between rolls 18 and 32. The carbon strip is then extended beneath adjacent bar 15, which serves as a snubber, and around rewind reel 36. Control dial 18 is then actuated to turn the motor on for rotating rolls 17 and 18 in the directions indicated in FIG. 2 and for likewise rotating rewind reel 36, at a slightly faster rate, in the direction shown therein, for rewinding the carbon strip during the decollating process. Rolls 17, 18 and 32 together function to separate forms $F_1$ and $F_2$ into separated plies $P_1$ and $P_2$ as roll 32 frictionally engages the mating surfaces of form $F_1$ and the carbon strip to thereby press forms $F_1$ and $F_2$ intimately against the peripheral surfaces of rolls 17 and 18, respectively. The interlocking paper staples 37 holding the forms together therefore detach more readily and positively with the present arrangement. And, in order to avoid slippage between the forms and their respective rolls 17 and 18, the peripheral surfaces of these rolls are roughened as shown in FIG. 1 so as to render them abrasive. Rotating rolls 17 and 18 then serve to direct the forms now separated into separate plies $P_1$ and $P_2$ over the adjacent guide means 24 and 25 which guide the forms in a "waterfall effect" therealong and, as the separated plies fall against surface 23 which lies outwardly of legs 21 and 22, the plies are refolded into separated zigzag stacks 39 and 41. The sloping portions 28 of the wire guides direct the separated plies outwardly of the decollator in the direction of the arrows shown in FIG. 2 so as to overlie pack breakers 42 which are respectively disposed outwardly of the machine legs on surface 23 in a location approximately at the midsection of each falling sheet 12. Continued falling movement of the separated plies thereafter causes the initial sheet to lay onto its pack breaker as it now falls progressively downwardly adjacent a leg of the machine. The next sheet of each ply, during the continued sliding movement thereof, then folds along its fold line l (normally comprising a line of perforations) so as to lay onto the previously folded sheet, and so on for the remaining sheets of the plies as they are refolded into zigzag packs 39 and 41 as shown in FIG. 2. The undercut sections of the wire guides facilitate refolding of the plies without interference.

The pack breakers are in the form of angle irons having their apices directed upwardly so as to cause the sheets of the refolded stacks to be bowed upwardly at their mid-sections. The refolded stacks are accordingly maintained neat appearing and neatly aligned as the folded sheets thereof are made to lie flatly against one another without interference by the separated tongues of paper staples 37. In other words, as a sheet such as **12*a* of the separated plies is in the process of laying over the sheet folded therebeneath, a sliding action between it and its underlying sheet is avoided during the process of falling between points 43 and 44 since the portion of the underlying sheet between these two points slopes downwardly by reason of the underlying pack breaker. Hence, the corresponding outward section of sheet 12*a* falls substantially vertically onto the underlying sheet between points 43 and 44**, rather than sliding thereagainst as would normally be the case without the use of a pack breaker. And, since a sliding action is avoided between the two sheets any interference such as tangling between the tongues of the separated paper staples is substantially avoided.

It should be pointed out that the positive separation between continuous plies in accordance with the invention applies equally as well for continuous forms having carbonless transfer material coated on mating surfaces thereof so as to thereby avoid the need for a carbon strip 38. Such coatings increase the friction between adjoining forms rendering them sometimes more difficult to separate as compared to uncoated forms. The separator roll therefore provides for a positive separation between such coated forms, and the pack breakers likewise avoid sliding between overlying sheets of the separated plies so as to thereby avoid the refolding of an unstable and misaligned stack.

It should also be pointed out that the separation of more than two continuous superimposed forms is contemplated with the machine according to the invention. If, for example, a stack of four or multiples of two continuous forms having interleaved carbon strips is to be separated, pairs of such forms (or multiples thereof) will be directed about respective rolls 17 and 18. Likewise, if the stack is formed of three superimposed continuous forms with interleaved carbon strips (or multiples of three), one (or more) of them may be fed over one of the rolls 17 and 18 with the remaining fed over the other for carrying out the decollating process, without departing from the scope of the present invention.

From the foregoing it can be seen that a decollator has been devised which makes use of a separator roll for insuring a more positive separation between continuous forms in a simple and economical yet highly effective manner. The separator roll is wholly supported by rotatable rolls 17 and 18 and frictionally engages the mating surfaces of the forms to be separated; and, the crowned configuration of the separator roll avoids any side-to-side tracking thereof during the separation process. Also, the wire guides configured in accordance with the invention permit the separated plies to freely fall downwardly for refolding without interference. Moreover, the use of pack breakers assures the formation of neatly formed refolded stacks.

Obviously, many modifications and variations of the invention are made possible in the light of the above teachings. It is therefore to be understood that within the scope of the appended claims the invention may be practiced otherwise than as specifically described.

What is claimed is:

1. A machine for decollating an assembly of continuous forms into individual plies, comprising an upstanding frame having a terminal end capable of being supported on a surface which likewise supports the assembly of forms to be decollated, a pair of driven feed rolls mounted on an upper portion of said frame and being rotatable in opposite directions away from one another, one ply of said assembly being fed over each of said driven rolls, guide means on said frame associated with both said rolls and sloping away therefrom toward said terminal end, a cylindrical forms separator roll, said rolls lying parallel and adjacent one another so as to define nips between said separator roll and said driven rolls, said separator roll bearing upon a portion of each said one ply which passes over said driven rolls and through said nips so as to be supported wholly by said driven rolls, said separator roll together with said driven rolls thereby effecting a positive separation of the forms into individual plies, and said driven rolls directing the individual plies over said guide means so as to be guided therealong onto portions of the surface.

2. The machine according to claim 1, wherein said driven rolls have a first predetermined length, said separator roll having a second predetermined length substantially less than said first length, and said separator roll being disposed at substantially a central portion between opposite ends of said driven rolls.

3. The machine according to claim 2, wherein said separator roll has a circular cross-section at its midportion of a predetermined size which is greater than a circular cross-section thereof at opposite ends, the cross-section of said separator roll gradually decreasing between said mid-portion and said ends thereof, whereby said separator roll is supported by said driven rolls at substantially said mid-portion so as to avoid movement along the central axis of said separator roll while the forms are being separated into individual plies.

4. The machine according to claim 1, wherein said driven rolls have roughened peripheral surfaces for avoiding slippage of the forms when directing the individual plies over said guide means.

5. The machine according to claim 1, wherein said guide means include a plurality of spaced rods extending in the direction from said driven rolls toward said terminal end and having first portions sloping in said direction, said rods having upstanding portions adjacent said terminal end and second portions interconnecting said first and upstanding portions, said second portions extending outwardly of said frame and thereby defining undercuts in said rods adjacent said upstanding portions whereby the individual plies, when formed of series-connected sheets, may be zigzag folded on said surface portions without interference from said rods.

6. The machine according to claim 1, wherein a rotatable rewind device is mounted on said upper portion of said frame for rewinding a continuous transfer strip disposed between the forms.

7. A machine for separating a stack of zigzag folded continuous superimposed forms detachably interconnected along at least one marginal edge, comprising a frame structure having depending legs for supporting said structure on a surface which likewise supports the stack to be separated, first and second rolls lying in a horizontal plane and being mounted on said structure for rotation in opposite directions away from each other, guide elements associated with said rolls and sloping downwardly away therefrom toward said legs, a third roll, said rolls lying parallel and adjacent one another so as to define a nip between said third roll and said first roll and a nip between said third roll and said second roll, said third roll bearing against and being wholly supported by said first and second rolls, whereby the forms may extend between said first and second rolls, one of the forms may extend through the nip between said third roll and said first roll and another of the forms may extend through the nip between said third roll and said second roll, said rolls together thereby effecting a positive separation of the forms into separate plies as said third roll functions to ensure detachment of the forms, said first and second rolls directing the separated plies over said guide elements so as to be guided therealong on to portions of the surface lying outwardly of said legs.

8. The machine according to claim 7, wherein said first and second rolls have roughened surfaces on their peripheries to avoid slippage of the separated plies when directing them over the guide elements.

9. The machine according to claim 7, wherein said guide elements include a plurality of rods having terminal ends and undercut portions therein adjacent said terminal ends to permit the separated plies to be zigzag folded on to the outwardly lying surface, pack breaker elements being disposed on said portions of said surface and comprising angular plates having apices directed upwardly and underlying the separated plies.

10. The machine according to claim 7, wherein said first and second rolls have a first predetermined length, and said third roll is disposed substantially centrally of said first and second rolls and has a length substantially less than said first length, said third roll having a central crown portion, whereby said third roll substantially avoids movement along its central axis upon rotation of said first and second rolls.

* * * * *